United States Patent [19]

Standiford

[11] 4,261,410

[45] Apr. 14, 1981

[54] ROLLAWAY INSIDE STORM WINDOW

[76] Inventor: Willard E. Standiford, 1 Englewood Rd., Baltimore, Md. 21210

[21] Appl. No.: 29,377

[22] Filed: Apr. 12, 1979

[51] Int. Cl.[3] ..... E06B 9/20

[52] U.S. Cl. ..... 160/269

[58] Field of Search ..... 160/266–269, 160/277

[56] References Cited

U.S. PATENT DOCUMENTS

| | | | |
|---|---|---|---|
| 32,034 | 8/1861 | Sawyer | 160/266 |
| 1,220,881 | 3/1917 | Nelson | 160/266 |
| 1,797,162 | 3/1931 | Stuber | 160/277 |
| 4,122,886 | 10/1978 | Marangoni | 160/269 |
| 4,126,174 | 11/1978 | Moriarty et al. | 160/266 |

*Primary Examiner*—Peter M. Caun

*Attorney, Agent, or Firm*—John F. McClellan, Sr.

[57] ABSTRACT

A self-adjusting, self-storing rollaway inside storm window for use at conventional windows, which can be quickly put up and taken down as desired, includes a transparent flexible panel mounted on and constantly tensioned at the top end by a spring-retracting roller in the manner of a window shade and deployable over a self-adjusting spring biased extension rod securable between the sides of a window frame at the top, and at the bottom loop-affixed around a similar self-adjusting spring biased extension rod also securable between the sides of the window frame; a special shock cord deployed along each side of the panel between the upper and lower self-adjusting spring loaded rods biases the vertical edges of the panel in a direction for sealing against the window frame structure; intermediate disconnects are provided in the shock cord, and special ends on the self adjusting spring loaded rods adapt them for securance to window frame structures of different types.

6 Claims, 9 Drawing Figures

ROLLAWAY INSIDE STORM WINDOW

This invention relates generally to storm windows and particularly to flexible storm windows which can be installed on the inside in front of the window frame.

In the prior art U.S. Pat. No. 4,126,174 to J. P. Moriarity et al discloses a "Flexible Sheet Rollup Window Structure" employing two rollers in a somewhat bulky, evidently expensive and elaborate structure for deploying transparent sheet material across the inside face of a window, much emphasis being placed on fixed guiding and securing structure through which the flexible sheet-edges must pass, with some reliance evidently made on finding suitable window frame shapes in all potential applications.

In contrast, according to objects of the present invention, the invention provides a rollaway inside storm window for fitting securely a variety of window frame shapes in a substantially wholly self-storing structure having provision for sealing along the lateral edges without need for edge engagements fixed to the windowsill.

Further objects are to provide a unit as described which can easily be installed, operated, and removed without any special skill; which is durable, economical, easily cleaned, pleasant in appearance, which can instantly be cleared away for window access in an emergency, and raised and lowered at any time.

Still further objects are to provide a unit as described which is easily manufactured using a maximum of readily available components, and which when folded is damage resistant and can be stored and shipped in small space.

And yet further objects are to provide in embodiments a choice of types of securance for components thereof.

In brief summary given as cursive description only and not as limitation the invention includes a flexible plastic panel having engagement with a spring return roller for mounting in a window frame, and deployable over first and second self-adjusting rods within a window frame, with elastic structure carried between said rods for forcing the edges of the plastic panel against corresponding edges of a window frame; in embodiments the self-adjusting rods may include both resilient, frictional retention ends and semi-permanent retention ends.

The above and other objects and advantages of the invention will become more readily apparent on examination of the following description, including the drawings in which like reference numerals denote like parts:

FIG. 1 shows the invention 10 installed in the interior of a building in front of a window assembly W (phantom lines), serving as a storm window which can help prevent condensation and can keep a room warmer and draft-free in winter, and if the room is air-conditioned, cooler in summer.

Figure 1:
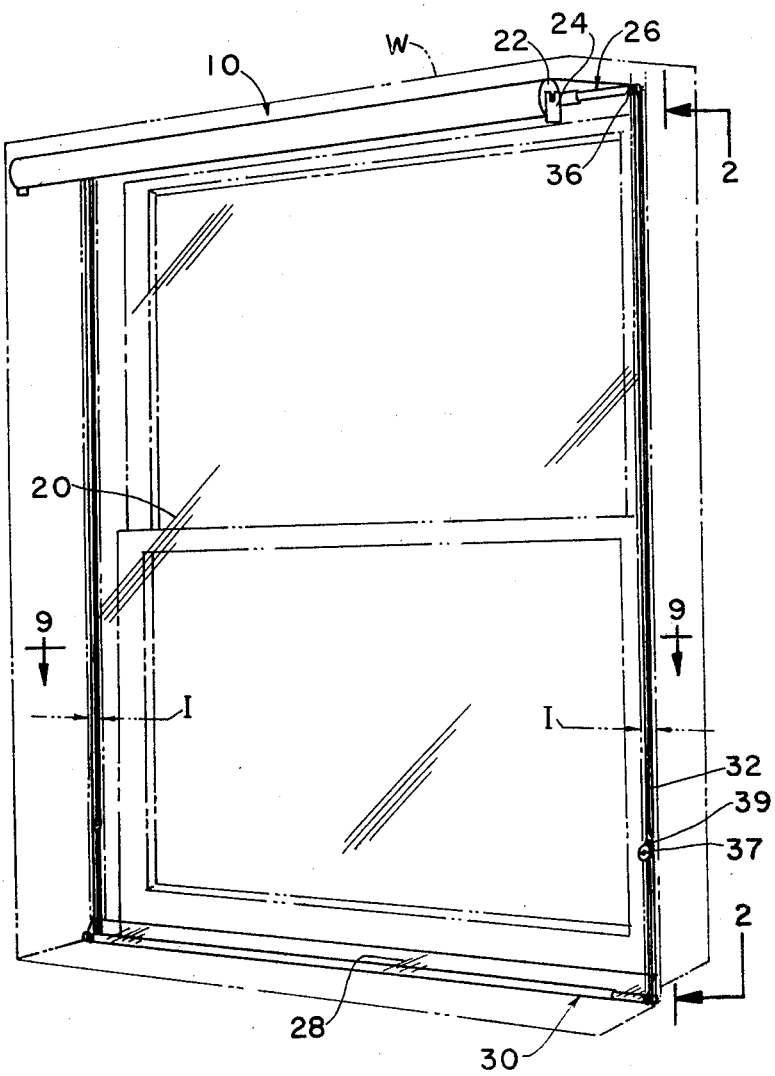
FIG. 1 is a perspective view of the invention installed front of in a window on the interior face of the window.
Figure 2:
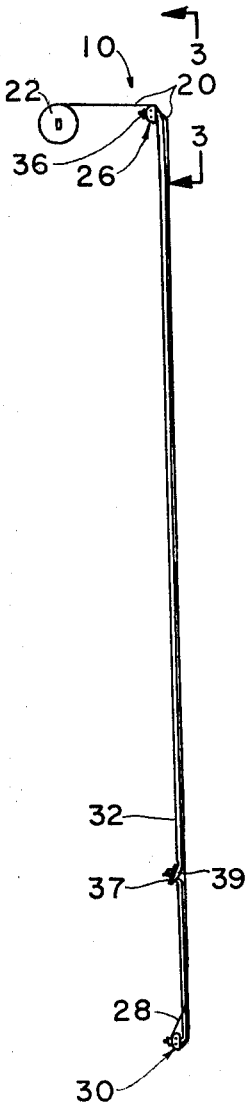
FIG. 2 is a rear elevational partial view of the structure of the invention taken from 2—2, FIG. 1.

FIG. 2, which is described with FIG. 1, shows a side elevational view of the invention.

The invention comprises generally a preferably transparent flexible plastic panel 20 which may be of "Mylar" rectangular in outline shape and 0.004 inch (0.1 mm) thick. The upper end is taped and rolled or otherwise conventionally held on a typical spring-return shade roller 22; typically mounted by brackets 24 near the front of the window frame. In the preferred embodiment the shade roller is modified as will be seen to exert tension constantly drawing upwardly on the flexible plastic panel. The brackets may be of the commercial type called interior brackets, meaning that they fit closely at the ends to the inside of the window frame.

From the roller the panel leads rearwardly toward the window, facing against the vertical ledge typically formed by the inside stop I (arrows show width) of the window frame.

There the panel passes over a first rod 26 and down along the window inside stop to the bottom of the window, where it secures in a loop 28 around a second rod 30 adjacent the sill. The rods thus comprise first and second mounting means.

The two rods assure that the panel fits back against the frame formed by the inside stop structure, which frame is usually joined by a transverse member at the top in the same plane as the inside stops.

An important feature of the invention securely holds the lateral or vertical edges of the panel 20 tightly against the inside stop structure and resists wind pressure which would tend to cause draft there. This edge holding feature comprises on each side of the panel a resilient member or longitudinally elastic line in the form of a length of shock cord 32 extending on the room-side or front proximate each edge of the panel from the end of the first or top rod to the end of the second or bottom rod which between them support it adjustably in tension.

The shock cord preferably comprises a typical bundle of elongate rubber strands housed in a "Nylon" woven extensible tubular covering or sleeve, the whole about one-eighth inch (3 mm) in diameter.

The shock cord may be adjustably secured at each end by means of a hole 34 (shown in FIGS. 3 and 5) perpendicularly through each respective rod through which it may be passed and knotted as at 36 to prevent pulling through the hole. Any length chosen may be knotted and tried, then the excess cut for neatness if desired.

In the preferred embodiment each shock cord has an intermediate disconnectable connection about one-third the distance up from the bottom permitting rod installation prior to shock cord tensioning. Said another way, the shock cord may be connected to exert the tension after installation. Each such connection may include a button 37 on one end passed through a loop 39 turned and whipped or otherwise formed in the other end. The button may be a washer passed through and held on the shock cord by a knot. Length adjustment may be by properly locating the knot and trimming off excess.

To cause the shock cords to press the edges of the panel, the rods 26, 30 are installed in the window frame with the axis of the holes horizontal, and the shock cords slightly under tension between the rods extend towards the window, so that the shock cords, which are sufficiently resistant to bending, abut tightly against and sandwich the respective edges of the panel between each shock cord and the proximate inside stop.

The shock cord may pass through the loops in appropriate holes for the purpose.

It will be apparent that this installation imposes a turning moment on the rods. The rod ends and the rods may be of any structure and installation suitable to resist twisting of the orientation.

Figure 3:
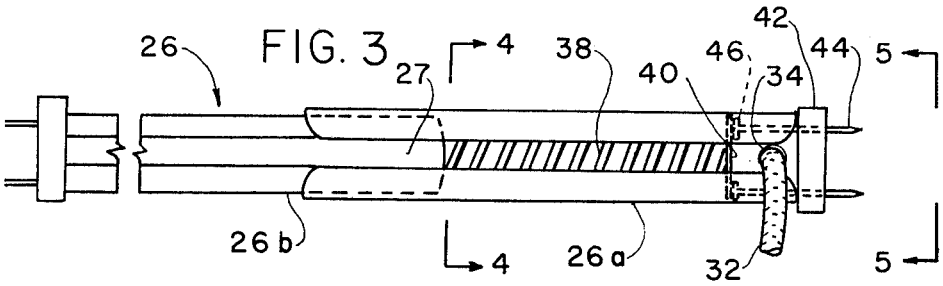
FIG. 3 is a rear elevational view of the upper rod taken from 3—3, FIG. 2.

FIG. 3 shows the preferred structure and installation means as follows, for purposes including simplicity, economy, ease of installation and adaptability. First, as noted, the rods preferably are similar spring-biased extensible assemblies, each comprising first and second lengths 26*a*, 26*b* (upper rod shown) which may be of ordinary "C"-section curtain rod, longitudinally slotted as at 27, telescoped together and resiliently biased longitudinally, to extend away from each other and increase the assembly length for exerting outward pressure against a window frame, by a compression spring 38 caught in an end of the first or larger rod between the outboard end of the second or smaller rod and a transverse plate 40 which may be wedged in the first rod.

Second, the rod ends provide for a non-twisting anchorage by means at each end of rubber capping in the form of a rubber plug 42 which retains itself by fitting the rod interior tightly and which holds protrusive sharp structure, which may be a pair of protrusive nail ends 44, the head 46 of the nails being thrust by the plug against the plate. The nails penetrate the wood of the window frame at the selected installation location and hold under the spring pressure against dislocation until the rods are telescoped shorter for removal when desired. The shock cord appears at 32 it passes through each rubber plug as well as rod portion.

Figure 4:
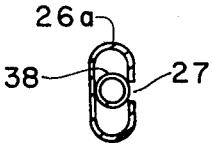
FIG. 4 is a cross-sectional view taken at 4—4, FIG. 3.

FIG. 4 shows a sectional view of a preferred rod assembly, the spring 38 advantageously being of a diameter closely holding it in within the rod "C" section and retained in location by partial protrusion through the slot 27 in the rod "C" section through which it is too large to pass but large enough to be held against by the back wall of the rod.

Figure 5:
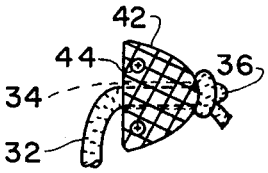
FIG. 5 is an end view taken at 5—5, FIG. 3.

FIG. 5 shows the end view of the rod assembly with the nails protruding, and details passage of the shock cord through the rod assembly, in which the shock cord fits tightly, preferably.

Figure 6:
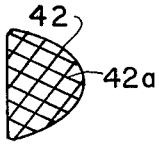
FIG. 6 is an end view of an alternate detail of a window frame engaging structure in a view similar to that of FIG. 5.

FIG. 6 shows a plug 42 a tread pattern 42*a*, the plug is without nails and can be used where the shape of the window frame is favorable, as when the sides are parallel or nearly so sufficiently for gripping. Steel-frame windows can be gripped with such structure also.

Figure 7:
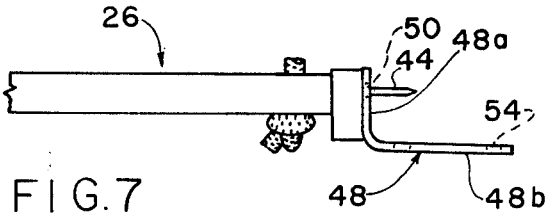
FIG. 7 is a partial plan view showing an alternate or modified detail of a window frame engaging structure; the view is similar to that of FIG. 3 but rotated 90°.

FIG. 7 details a provision usable with window frames which are of odd shape or otherwise of very little holding potential for the rods. This provision may be a mild steel strap about three-fourths of an inch wide. The strap is bent or bendable into an angle 48 which is "L" shaped to fit the window frame and is installed over the nails by hole 50 in one leg 48*a*, with the other leg 48*b* extending longitudinally in position to be secured to a window frame inside stop by holes 54 in it through which screws or nails may be passed, providing a means of semi-permanent affixation from which the rods may be detached at any time.

Figure 8:
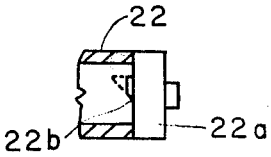
FIG. 8 is a schematic detail of a roller end showing a modification of a conventional window shade roller in a longitudinal, partially sectional view of an end of the roller.

FIG. 8 schematically details one method of providing capacity for a conventional shade roller 22 to exert tension constantly as in the preferred embodiment of this invention. At the fixed end 22*a* the tips of the ratchet wheel 22*b* are filed off (broken lines show removal) or otherwise removed so that they do not engage the conventional pawl structure (not shown) permitting the roller spring to keep the plastic sheeting taut and prevent thermal-expansion buckling, draft dislocation and the like. Alternatively the pawl may simply be omitted or removed, as will be obvious to one skilled in the art.

To install the panel requires only to mount the shade roller on the brackets, draw the panel down against the roller bias, the bias continuing at all roller positions, mount the rods, and connect the shock cord at the intermediate connection points.

Figure 9:
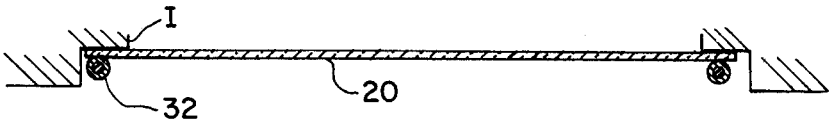
FIG. 9 is a partial cross-sectional view taken from 9—9, FIG. 1, showing the relation of parts of the assembly to the window stops.

In operation to rollaway upward the panel requires only grasping the ends of the bottom rod and forcing them towards each other, and letting the spring roller draw the panel upward; the shock cords may be disconnected at the intermediate points first to relieve the tension they impose between the rods. FIG. 9 is a fragmentary sectional view, taken from 9—9, FIG. 1 and further showing the relation of the panel 20 to the elastic lines 32 and the window stop I; sizes are exaggerated for exposition.

In conclusion, it will be evident that as a starting point for manufacture, ordinary curtain rods, shade roller, spring, nails, shock cord and plastic sheeting may be used, at great savings in special tooling, cost of materials, fabrication and assembly.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by U.S. letters patent is:

1. In a storm window for mounting in front of a window frame and having: a flexible panel with upper and lower ends and lateral edges, roller means affixable at the top of a said window frame and having attachment to said upper end of said flexible panel and spring biased for drawing up the flexible panel onto the roller means, first means for mounting to a window frame rearwardly of the roller means and holding an upper portion of the flexible panel against the window frame, second means for mounting to and holding said lower end of said flexible panel against a said window frame, and means for holding said lateral edges against a said window frame, the improvement comprising: said means for holding the lateral edges including a respective resilient member (32) extending along the front of the flexible panel (20) proximate each edge thereof, the first means (26) for mounting and holding the flexible panel supporting the upper end of each resilient member (32), and the second means (30) for mounting and holding the flexible panel supporting the lower end of each resilient member (32); each resilient member (32) comprising a cord (32), each cord (32) being longitudinally elastic and said holding of the lateral edges including action of tensioning of each cord (32) between the first means (26) for mounting and holding the flexible panel and the second means (30) mounting and holding the flexible panel; each said cord (32) having sufficient bending resistance to abut against a said lateral edge when portions of said cord (32) respectively proximate said first and second means (26, 30) for mounting and holding the flexible panel are bent rearwardly at the window frame, said first and second means (26, 30) for mounting and holding the flexible panel having respectively at each end thereof means for preventing twisting, including each of said first and second means (26, 30) for mounting and holding the flexible panel being an assembly of parts (**26*a*, 26*b*) with length-increasable telescopic relation and each assembly having means (38) resiliently biasing it toward length increase; and said assembly including rubber capping (42) at the respective ends of the first and second means (26, 30**) for mounting and holding the flexible panel.

2. In a storm window as recited in claim 1, said means for preventing twisting including, at said each end of the first and second means (26, 30) for mounting and holding the flexible panel, protrusive sharp structure (44).

3. In a storm window as recited in claim 1, said assembly of parts (**26*a*, 26*b*) with length increasing telescoping relation comprising first and second members (26*a*, 26*b*) each forming in section a "C" shape, and said means resiliently biasing comprising a compression spring (38) closely held within the "C" shape of the first member (26*a*) in abutting relation to the second member (26*b***).

4. In a storm window as recited in claim 1, each said cord (32) including an adjustable detachable connection (37, 39) intermediate the length of each said cord (32).

5. In a storm window as recited in claim 4, each said adjustable detachable connection comprising a button-and-loop attachment (37, 39).

6. In a storm window as recited in claim 4, said tensioning being adjustable, said adjustment including provision (36) for varying length of each cord (32) between said first and second mounting means.

* * * * *